United States Patent [19]

Torres

[11] 4,107,813

[45] Aug. 22, 1978

[54] WAX-STRIPPER AND APPLICATOR DEVICE

[76] Inventor: Richard J. Torres, 1025 Grevelia St., South Pasadena, Calif. 91030

[21] Appl. No.: 826,153

[22] Filed: Aug. 19, 1977

[51] Int. Cl.[2] ..... A47L 11/03

[52] U.S. Cl. ..... 15/246; 15/320; 239/172

[58] Field of Search ..... 15/50 R, 50 C, 51, 52, 15/320, 321, 246; 239/172, 289

[56] References Cited

U.S. PATENT DOCUMENTS

| | | | |
|---|---|---|---|
| 1,878,508 | 9/1932 | Menkhaus | 15/50 R |
| 3,464,081 | 9/1969 | Wisner | 15/321 |
| 3,496,591 | 2/1970 | Sheler | 15/320 |

*Primary Examiner*—Edward L. Roberts

*Attorney, Agent, or Firm*—Francis X. LoJacono

[57] ABSTRACT

A wax-stripper and applicator device that is used in combination with well-known automatic scrubbing machines for cleaning large floor areas, the stripper and applicator device being arranged to be removably mounted to the front portion of the automatic scrubber to aid in the dispensing of various kinds of cleaning or wax solutions that at present are not included within the known scrubbing machines. The device comprises a first and a second liquid storage compartment defined by a pair of separate tanks, wherein the liquid in each tank is separately discharged by means of a self-contained motorized pump having dual-control valves so as to select the proper solution for discharge through an adjustable nozzle positioned forward of the tanks and automatic scrubber.

10 Claims, 7 Drawing Figures

60
42
58
54
44
45
46
40
27
30
28
16
64
55
36
14
34
64
35
70
72
60
54
40
14

WAX-STRIPPER AND APPLICATOR DEVICE

BACKGROUND OF THE INVENTION

1. Field of the Invention

This invention relates generally to cleaning, scrubbing and waxing of floors — and, more particularly, to a device that is used in combination with known automatic scrubbing machines so as to complement the operation of the scrubbing machines, whereby undercoating sealers and wax solutions can be evenly sprayed over the floor area.

2. Description of the Prior Art

As is well known in the art, various problems and difficulties are encountered in providing suitable means for cleaning, scrubbing and waxing of large floor areas, such as found in grocery and department stores, hospitals, office buildings, etc.

There are many and varied types of cleaning devices used for scrubbing and cleaning large floor areas, particularly those floors covered with plastic or composition tile floors and where there is very heavy foot traffic as well as heavy vehicle traffic — such as grocery carts, portable machines, etc. In those establishments where food products are stored and the loading of fresh produce takes place throughout the day as in grocery stores, it is necessary to wash the open areas and aisles between the commodities on shelves at least once a week — preferably twice a week, and waxing at least once. Thus, it is essential that an even wax coat be maintained to protect the floors.

At present, there are available several types of automatic cleaning and scrubbing machines, the trade names for some of these devices are known as "Tornado," "Kent" and "Multi-Clean." These machines generally comprise one or two motors that drive a brush or pad-holder-drive brush, a vacuum, a squeegee, and in some cases a drive motor for the entire machine. Also included are two tanks — one tank to dispense a solution through the brush, and the other tank to recover the scrubbed solution through a vacuum system. Most automatic scrubbers on the market are self-contained and are primarily operated by batteries, either a 24 or 36-volt system. The original intent of the automatic scrubber was to put solution onto any hard-floor surface from one of the two tanks, the solution being discharged through the brush or brushes by means of a discharge tube. The solution is spread and agitated with the brushes mounted at the front of the machine. As the machine passes over the scrubbed area with the solution disposed thereon, the squeegee attached to the rear of the machine collects the solution, thus allowing the solution to be sucked up through a hose running from the other tank with a vacuum motor attached thereto. Thus, the scrubbed solution is picked up from the floor and deposited in the recovery tank.

Accordingly, these scrubber machines eliminate the part process used wherein one man used a floor mop and bucket to put down a solution and another man came behind him with a vacuum, recovering the solution the first man scrubbed. The solutions used included stripping solution, scrubbing solution or rinsing solution.

The automatic scrubbers as known reduced the labor required for maintenance, which in the floor-cleaning field is about 80% of the cost of doing business.

However, there are still additional improvements needed in order to reduce the hours of labor yet required. With the combination of the above automatic cleaning machines and the hereinafter described invention, further reduction in time, cost and labor can be established.

SUMMARY OF THE INVENTION

The present invention comprises a wax stripper and applicator that is used in combination with automatic scrubbing machines as previously herein described. The was stripper and applicator comprises two tanks — one being removably supported by the other — wherein there is defined a first or forward storage chamber and a second or rear storage chamber. When the tanks are mounted together forming a single unit, the unit is removably strapped to the front of any suitable well-known scrubber machine.

Each tank is individually arranged to be connected to a motorized pump, whereby solution disposed in the tanks can be selectively sprayed therefrom by respective control valves disposed between respective tanks and the pump. The pumping system also includes a solenoid-controlled valve as well, which is remotely operated by a switching means, whereby the solution from either tank enters the pump on the inlet side thereof and is discharged through the outlet side to which an adjustable spray nozzle is attached.

OBJECT AND ADVANTAGES OF THE INVENTION

The present invention has for an important object a provision wherein stripping and waxing solutions can be sprayed ahead of a scrubbing machine, and wherein greater floor surface areas can be covered with a more even coat.

It is another object of the invention to provide a wax stripper and applicator that is compatible with existing floor-scrubbing machines.

It is further another object of the invention to provide a wax stripper and applicator device that allows for various combinations of solutions to be sprayed therefrom and that will provide any number of cleaning steps, depending on the particular cleaning and waxing requirements for any given situation.

It is a further object of the invention to provide a device that can be combined with existing automatic floor scrubbers and cleaners, wherein the device is designed to be removably mounted thereto.

A still further object of the invention is to provide a device of this type wherein a spray nozzle is included, this nozzle being adjustable to evenly spray solutions in difficult areas of the floor surface, where heretofore hand mops had to be used — thus saving time and labor.

It is another object of the invention to provide a device of this character that is simple and rugged in construction.

It is still another object of the invention to provide a device of this character that is easy to service, maintain and instal l on existing machines, and that will operate on the self-contained power supply found in most scrubbing machines.

And still a further object of the present invention is to provide a device of this character that is relatively inexpensive to manufacture.

The characteristics and advantages of the invention are further sufficiently referred to in connection with the accompanying drawings, which represent one embodiment. After considering this example, skilled persons will understand that variations may be made without departing from the principles disclosed and I contemplate the employment of any structures, arrangements or modes of operation that are properly within the scope of the appended claims.

DESCRIPTION OF THE DRAWINGS

Referring more particularly to the accompanying drawings, which are for illustrative purposes only.

DESCRIPTION OF THE PREFERRED EMBODIMENT

Figure 1:
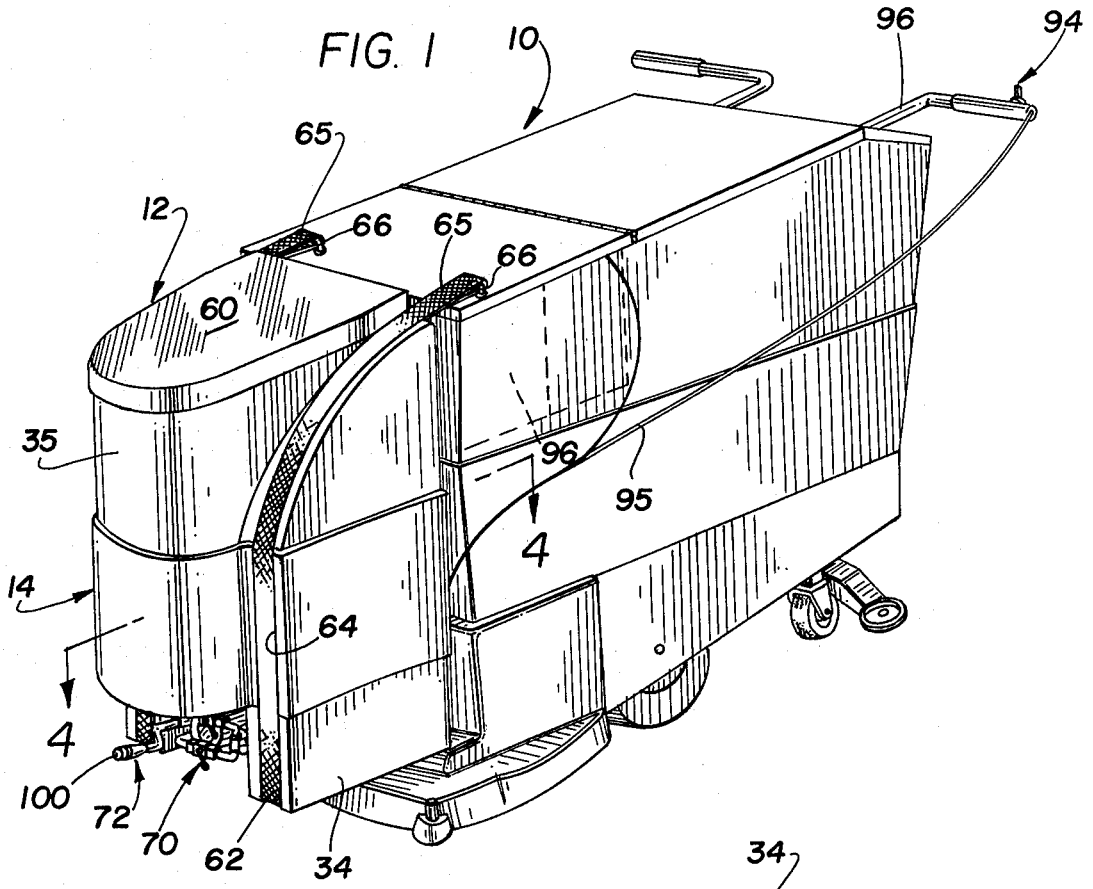
FIG. 1 is a perspective view of the present invention shown attached to a suitable automatic scrubbing machine.

Referring more particularly to FIG. 1, there is shown an automatic scrubbing machine, generally indicated at 10, having the present invention, a wax stripper and applicator unit designated at 12, attached to the front end thereof.

As is well known in the art, various types of automatic scrubbing machines are available; and these generally include two tanks therein (not shown) wherein one tank is provided to store and dispense various cleaning and rinsing solutions, and the second tank forms part of a vacuum system whereby the solutions deposited on the floor surface by the first tank are vacuumed and stored in the second tank. Thus, a solution is discharged from one of the tanks onto and through a rotatable brush or brushes by means of a tube, the brushes being positioned adjacent the front of the machine in order to work the solution over the floor surface. As the machine passes over the scrubbed area, the solution thereon is collected by a squeegee device attached to the rear of the machine. At this point, the scrubbing or rinsing solution is picked up from the floor by a vacuum hose extending from the vacuum tank. Therefore, it should be noted that this type of machine is designed for use only with scrubbing solutions, stripping solutions and rinsing solutions. That is, at present waxing must still be done by the old-type mop application, or similar method, after the use of the floor scrubber.

Figure 4:
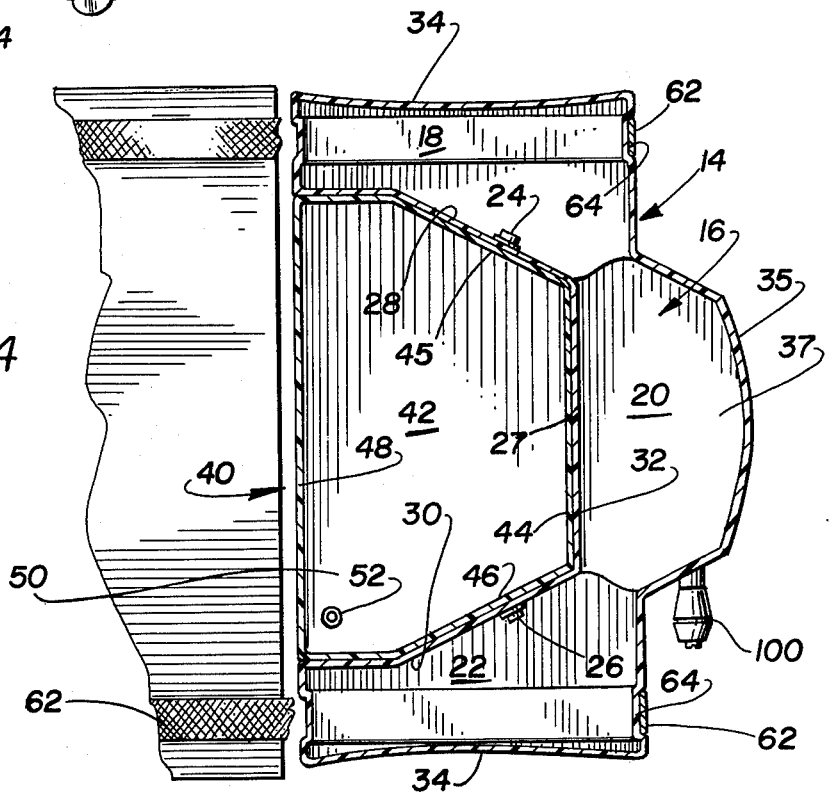
FIG. 4 is an enlarged, cross-sectional view of the combined tanks taken along line 4—4 of FIG. 1 thereof.
Figures 2, 3:
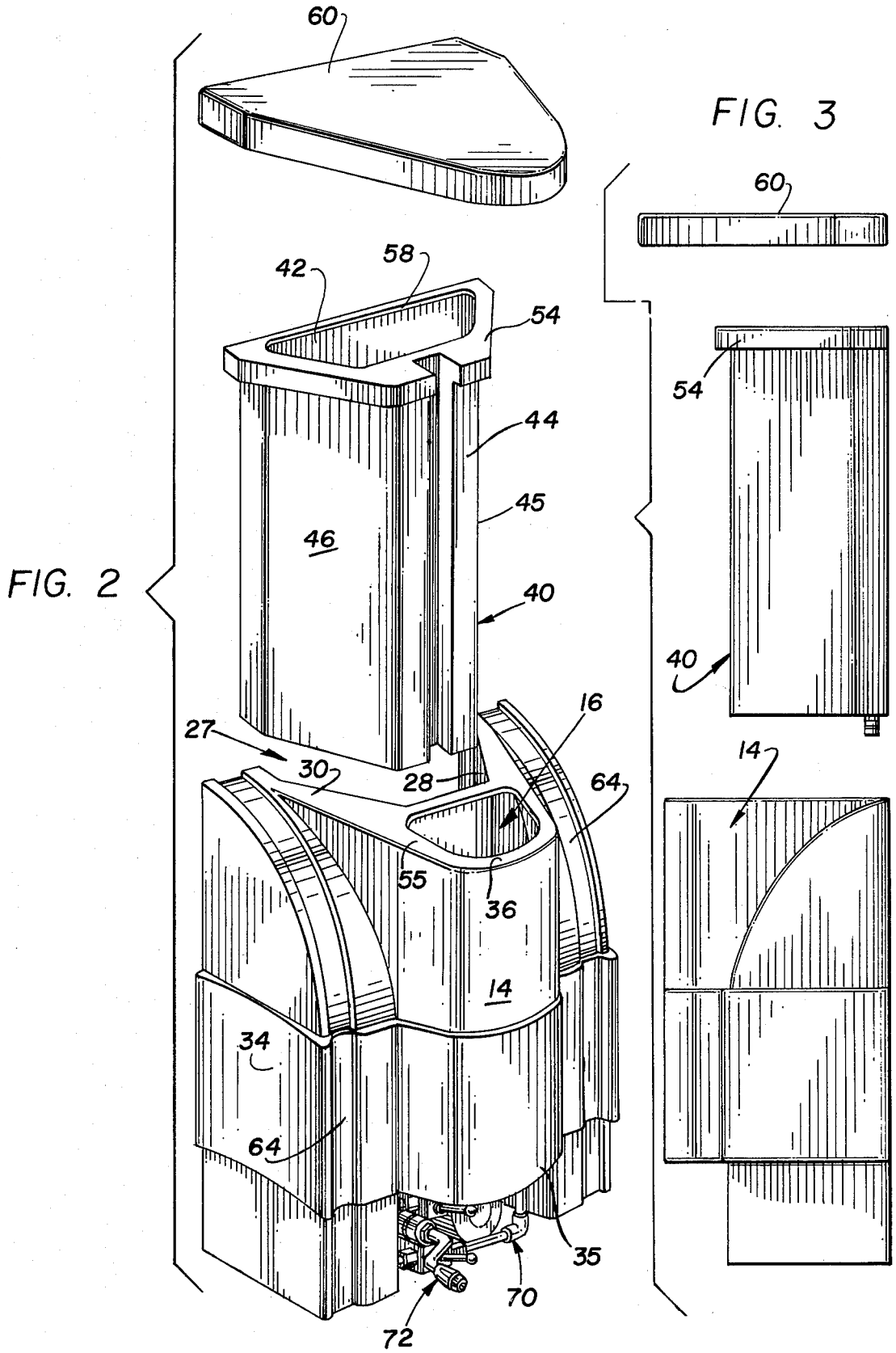
FIG. 2 is an exploded view of the invention, illustrating the arrangement and location of the forward or first tank with respect to the rear or second tank.
FIG. 3 is a side-elevational view of that seen in FIG. 2.
Figure 6:
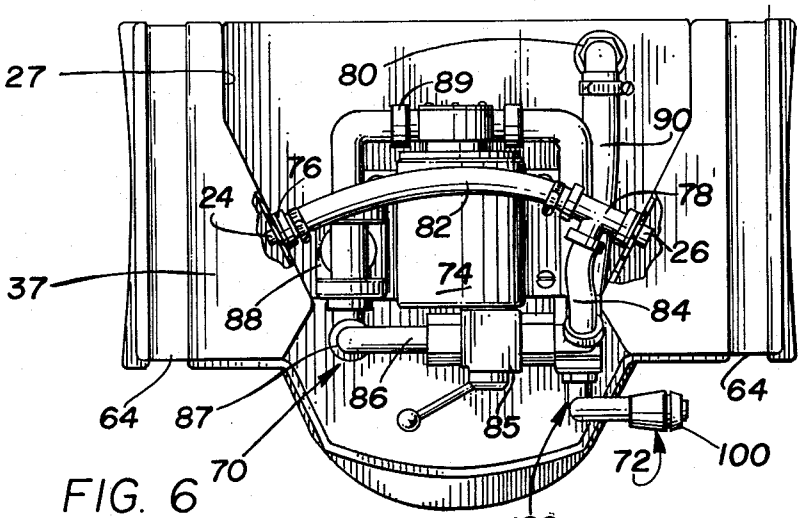
FIG. 6 is a bottom plan view thereof.

Thus, the present invention now becomes an important addition to the well-known scrubber machine when employed in combination therewith. The wax-stripper and applicator device 12 comprises a main housing or front tank 14 defining a storage chamber 16 having a plurality of interconnected compartments 18, 20 and 22, wherein compartments 18 and 20 have outlet parts 24 and 26, respectively. These compartments are arranged whereby front tank 14 is formed in a substantially "U"-shaped configuration, as seen in FIGS. 2 and 4. The "U"-shaped configuration is established by tapered walls 28 and 30 of respective compartments 18 and 22, and by rear flat wall 32 of compartment 20. The main tank 14 is further defined by side walls 34, front wall 35, and bottom wall 37. Chamber 16 is provided with an access opening 36, as seen in FIG. 2.

A second or rear storage tank, generally indicated at 40, defines a storage chamber 42. Said rear tank comprises a front wall 44, inclined side walls 45 and 46, rear flat wall 48, and bottom wall 50, said bottom wall having an outlet means 52 — the overall cross-sectional configuration thereof as seen in FIG. 4 being arranged to be received in channel 27 of front tank 14. That is, rear tank 40 fits within channel 27 and is supported therein by a peripheral outwardly extended flange member 54 which rests on the upper wall 55 of tank 14. Flange 54 also defines the upper or top wall 56 of tank 40 wherein an enlarged opening 58 is disposed.

Figure 5:
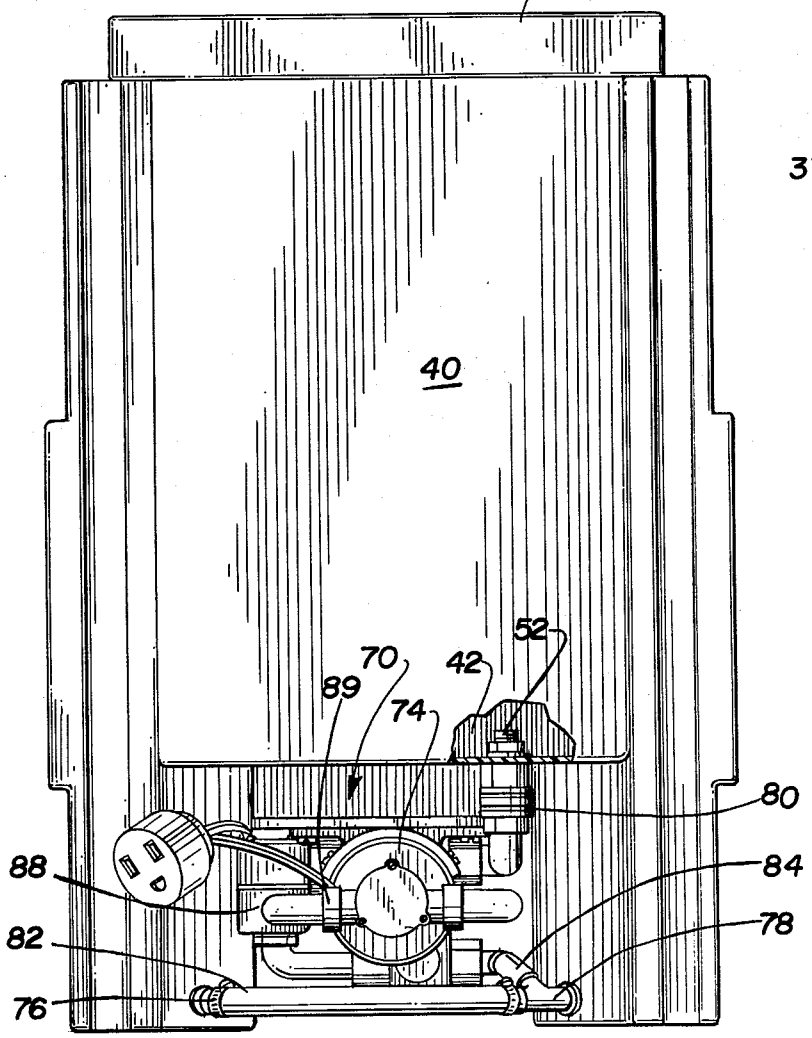
FIG. 5 is a rear-elevational view of the device, showing the arrangement and location of the pumping system between each tank.

When each tank 14 and 40 are positioned together, as seen in FIGS. 1 and 5, a cover 60 is provided to be positioned over opening 36 and 58 of respective tanks to prevent foreign matter from reaching the stored solution.

Various means to removably secure the overall unit to the automatic scrubber machine can be used; however, the simplest form is herein shown wherein there is a pair of straps 62 having one end secured to the outer tank 14 adjacent the bottom thereof, and then passing over the front wall 35 which is formed with a pair of oppositely disposed grooves 64 in which each strap 62 is received, as seen in FIGS. 1 and 4.

The free ends of straps 62 are provided with removable buckle means 65 that are made to couple with hold-down bar members 66 secured to the top of scrubber machine 10.

Mounted below tanks 14 and 40 is a pump means, generally indicated at 70, and a spray means 72. The pump means comprises a suitable well-known pump-and-motor combination unit 74 which is arranged to be selectively communicated with compartment 16 of the forward tank 14 and the rear tank compartment 42. That is, outlet openings 24 and 26 of chambers 18 and 22, respectively, are provided with fittings 76 and 78, respectively; and outlet 52 is provided with a quick-disconnect fitting 80. The quick-disconnect fitting 80 allows for simple removal of rear or inner tank 40.

Accordingly, chamber 18 and 20 form part of compartment 16, and are thus interconnected to pump 74 by a hose 82 positioned between fitting 76 and 78, A second hose connection 84 leads to a hand-operated valve means 85. Valve 85 controls solution flow from tank 14 into pump 74 by way of pipe 86 secured to a "T" fitting 87, which communicates with sollenoid valve 88, the solenoid valve being connected to pump 74 at its inlet port 89.

Figure 7:
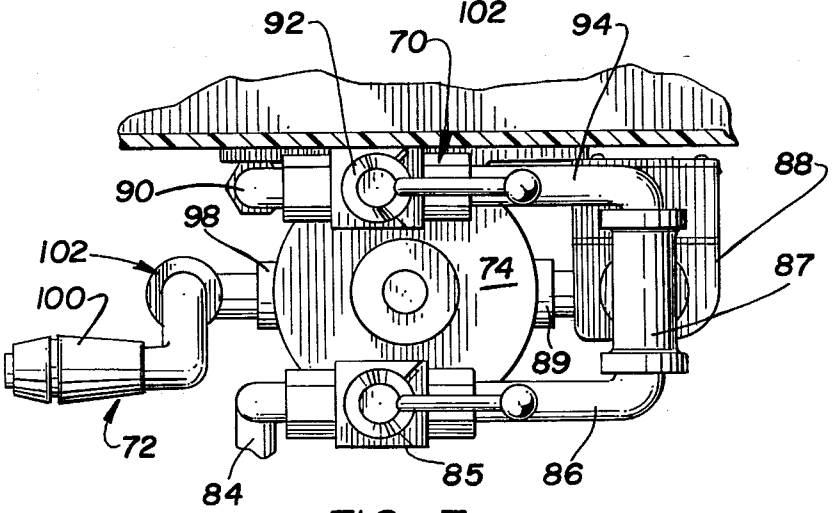
FIG. 7 is a detailed view of the arrangement and location of the valve-control means with respect to the pump and spray nozzle.

Tank 40 is operably connected to pump 74 by hose 90 which is attached at one end to quick-disconnect fitting 80 and at the other end to a second hand-operated valve 92, as seen in FIG. 7. From valve 92, a connecting hose 94 is attached to "T" fitting 87 in order to feed a controlled flow of the stored solution from tank 40 and into solenoid valve 88. Hence, valves 85 and 92 provide the means to select flow from respective tanks 14 and 40 into solenoid valve 88 which is electrically operated by switch means 94. Said switch means is shown mounted to the handle 96 of scrubber machine 10. Pump 74, solenoid valve 88, and switch means 94 are operably connected by a wiring system indicated at 95, wherein said wiring system is connected to a power supply which is self-contained in machine 10.

Any suitable power supply can be employed; however, in most cases the power supply comprises a plurality of batteries 96 which provide 24 to 36-volt systems.

Thus, as an example, an undercoating sealer solution can be stored in tank 14, with a finished wax solution disposed in tank 40. Valve 85 would be positioned in an open mode, allowing the undercoating sealer solution to be pumped through electrically operated valve 88 and into pump 74, thus discharging from pump outlet port 98 whereby the solution is pumped under pressure through spray means 72 comprising an adjustable spray nozzle 100 having swivel means 102. Spray nozzle is freely adjustable in any suitable direction, depending upon the contour of the floor area.

Once the undercoat is applied, the operator of the machine closes valve 85 and opens valve 92 — thereby allowing flow of the wax solution stored in tank 40 to pass through the pump and spray system of the device.

When the automatic scrubber is used alone, as is presently the case, the scrubber has its working limitations. It can only deposit the particular solution, scrub, and then vacuum it back in.

However, when the automatic scrubber is used in combination with the present invention, numerous additional steps and methods can be selected. Accordingly, the steps of stripping, scrubbing, rinsing, undercoating a sealer, and waxing can be arranged in various ways under different conditions during any given operation. This versatility has heretofore been unattainable.

The invention and its attendant advantages will be understood from the foregoing description and it will be apparent that various changes may be made in the form, construction and arrangement of the parts of the invention without departing from the spirit and scope thereof or sacrificing its material advantages, the arrangement hereinbefore described being merely by way of example, and I do not wish to be restricted to the specific form shown or uses mentioned, except as defined in the accompanying claims.

I claim:

1. A wax-stripper and applicator device for use with an automatic scrubbing machine, wherein the device comprises:

attaching means to removably mount said device to said machine;

a first tank defining a storage chamber to receive a solution therein, and having at least one outlet port disposed therein;

a second tank defining a second storage chamber to receive a solution therein, and having at least one outlet port disposed therein, said second tank being supported by said first tank and being removable therefrom;

a pump means operably mounted to said device and connected to each of said chambers of said tanks to receive solution stored therein;

a first valve means operably disposed between said first chamber and said pump means;

a second valve means operably disposed between said second chamber and said pump means; and an adjustable spray means mounted to said pump means, whereby said solutions in said tanks can be selectively sprayed therefrom.

2. A device as recited in claim 1, wherein said device includes a solenoid valve means interposed between said pump means, and said first and second valve means, whereby the flow of fluid from said valve means to said pump means is controlled thereby.

3. A device as recited in claim 2, wherein said first tank includes a perpendicular channel adapted to receive said second tank therein.

4. A device as recited in claim 3, wherein said first chamber of said first tank includes:

a pair of side chambers, each having an outlet port disposed therein; and a forward intermediate chamber contiguously connected to each side chamber.

5. A device as recited in claim 4, wherein said device includes an electrical circuit having a switch means to operate said pump means and said solenoid valve means.

6. A device as recited in claim 5, wherein said device includes a removable cover; and wherein each of said tanks is provided with an opening to receive solutions therethrough, said openings being positioned to be simultaneously covered by said cover.

7. A device as recited in claim 6, wherein said spray means comprises:

an adjustable spray head; and an adjusting means for said spray head secured between said head and said pump means

8. A device as recited in claim 7, wherein said pump means comprises:

a pump having a motor mounted thereto, and having an inlet port and an outlet port;

a first hose means connected to said pair of side chambers; and a second hose means connected to said chamber of said second tank;

said first valve means being operably positioned in first hose means; and said second valve means being operably positioned in said second hose means.

9. A device as recited in claim 8, wherein said attaching means comprises:

a pair of oppositely disposed grooves formed in said first tank;

a pair of elongated straps positioned in said respective grooves; and removable connecting means attached to the ends of said straps and removably secured to said machine.

10. A device as recited in claim 9, wherein said channel in said first tank is defined by a substantially "U"-shaped configuration of said tank; and wherein said second tank includes a peripheral flange member located at the open end thereof.

* * * * *